US005622572A

United States Patent [19]

Wells, Jr. et al.

[11] Patent Number: 5,622,572

[45] Date of Patent: Apr. 22, 1997

[54] EXTRA-STRENGTH STEEL AND METHOD OF MAKING

[75] Inventors: Alfred H. Wells, Jr., Williamsburg; Gerald M. Cobb, Hampton, both of Va.

[73] Assignee: Newport News Shipbuilding and Dry Dock Company, Newport News, Va.

[21] Appl. No.: 520,463

[22] Filed: Aug. 28, 1995

[51] Int. Cl.[6] ..... C22C 38/04; C22C 38/06; C21D 6/00

[52] U.S. Cl. ..... 148/320; 148/661

[58] Field of Search ..... 148/320, 654, 148/661; 420/127

[56] References Cited

U.S. PATENT DOCUMENTS 4,115,155 9/1978 Roe ..... 148/654

*Primary Examiner*—Deborah Yee
*Attorney, Agent, or Firm*—Lalos & Keegan

[57] ABSTRACT

A steel plate has a minimum yield strength of 65 ksi, a tensile strength minimum of 78 ksi, a minimum elongation in 8 inches and 2 inches for a plate up to 24 inches in width of 18% and 22% respectively and a minimum elongation of 16% and 20% for a plate wider than 24 inches and a minimum Charpy V-notch energy of 30 ft-lb longitudinal and 20 ft-lb transverse at −40° F. and a composition of the following weight percentages:

a) carbon 0.03–0.10, b) manganese 1.10–1.65, c) phosphorous 0.025 max, d) sulfur 0.010 max, e) silicon 0.10–0.50, f) nickel 0.40 max, g) chromium 0.20 max, h) molybdenum 0.03–0.08, i) copper 0.35 max, j) vanadium 0.04–0.10, k) columbium 0.02–0.06, l) aluminum 0.03–0.08 and treated by heat treating and/or rolling.

9 Claims, No Drawings

EXTRA-STRENGTH STEEL AND METHOD OF MAKING

FIELD OF THE INVENTION

The general technology field of this invention is structural steel plate. More specifically, the field of this invention includes the process for the manufacture of high-strength, low alloy structural steel plate having unique performance characteristics and the steel plate products produced for marine and other structural applications.

BACKGROUND OF THE INVENTION

U.S. Navy surface ships and submarines are presently constructed of structural steel plates that are rolled to four basic yield strength (kips per square inch or ksi) levels: ordinary or medium (aka mild) strength—(32–34 ksi); higher-strength or high-tensile strength (HTS)—(45.5–51 ksi); high-yield strength Grade HY-80 or HSLA-80—(80 ksi); high-yield strength HY-100 or HSLA-100—(100 ksi).

Previous engineering experience with the hull structural design of U.S. Navy aircraft carriers and cruisers provided the background to recognize the need for a 65-ksi steel that would offer naval architects, and design engineers of naval ship structures, a new cost-effective plate steel. The following factors were also to be considered:

A) It was believed that the use of a stronger steel in lieu of high-tensile steel (HTS) would allow a reduction in thickness of the plate and therefore the weight and still satisfy most design criteria and technical requirements.

B) Additionally, earlier experience with the development of HSLA-80 steel provided the background to recognize that a low-carbon steel would offer improvements in weldability compared to HTS plates.

C) There was also a need to provide better fracture toughness performance than that of HTS steels since the Navy is interested in improving ship survivability by preventing crack propagation in critical ship structures.

D) The physical characteristics of steel plate that must be met to provide the benefits for achieving a stronger, tougher, easily weldable steel plate having a high resistance to crack propagation are the following: a yield strength of a minimum of 65 ksi, a tensile strength of a minimum of 78 ksi, a minimum elongation in 8 inches and 2 inches for a plate up to and including 24 inches in width of 18% and 22% respectively and a minimum elongation of 16% and 20% for plate wider than 24 inches. Previously known plate steels could not provide these characteristics economically, if at all.

In the past, various modifications were made in the chemistry of the steel so as to meet selected requirements. However, the addition of expensive ingredients or the increase in the amounts utilized also increased the cost of the resulting products, often without corresponding increases in the steel plate performance characteristics.

Prior art U.S. Pat. Nos. 4,395,296 and 4,142,922 are typical of the attempts to produce a high strength steel plate with requisite toughness, but for one reason or another they failed to meet the desired specifications. U.S. Pat. No. 4,395,296, for instance, lacked the disclosure of the required chemistry for any steel plate produced. U.S. Pat. No. 4,142,922 discloses that manganese is not required in a significant amount and therefore limits the amount to 0.60% by weight, which is much too low for a low carbon steel such as for the present invention.

SUMMARY OF THE INVENTION

In order to produce a steel plate having a minimum yield strength of 65 ksi, a tensile strength minimum of 78 ksi, a minimum elongation in 8 inches and 2 inches for a plate up to and including 24 inches in width of 18% and 22% respectively and a minimum elongation of 16% and 20% for a plate wider than 24 inches and a minimum Charpy V-notch energy of 30 ft-lb longitudinal and 20 ft-lb transverse at −40° F., it is necessary to utilize a novel steel composition having the following percentages by weight:

a) carbon 0.03–0.10
b) manganese 1.10–1.65
c) phosphorous 0.025 max
d) sulfur 0.010 max
e) silicon 0.10–0.50
f) nickel 0.40 max
g) chromium 0.20 max
h) molybdenum 0.03–0.08
i) copper 0.35 max
j) vanadium 0.04–0.10
k) columbium 0.02–0.06
l) aluminum 0.03–0.08

The steel having that chemistry must then be treated in any one of several ways in order for the steel to be formed into a plate having the physical characteristics above identified.

In a first method for forming a steel plate from a steel slab, the slab is rolled at a temperature between about 1900° F. to 1700° F. at which the columbium carbides and columbium carbo-nitride precipitates form to refine the austenitic grain size and thereafter rolling the slab at a temperature range of about 1700° to 1450° F. followed by cooling the slab to ambient temperature.

The second process comprises heat soaking a steel slab or ingot embodying the composition between 2200° F. and 2350° F., rolling the steel slab as the steel slab cools from about 1900° F. to just above about 1615° F. Thereafter, the second process comprises rolling the steel slab while cooling below 1615° F. to about 1330° F. and finally cooling the steel slab to ambient temperature.

The third process comprises heating the steel slab formed into a steel plate to a temperature between about 1450° F. and 1700° F. to complete a phase transformation from ferrite and pearlite to austenite and thereafter cooling the steel plate in still air to ambient temperature.

The fourth process comprises heating a rolled steel plate having the above composition to a temperature between about 1450° F. to 1700° F. to generate an austenite phase transformation, quenching the steel plate to at least below the temperature of about 600° F. and then tempering to relieve any quenching stresses at a temperature of about 1050° F. to 1330° F. followed by cooling the steel plate to ambient temperatures.

DESCRIPTION OF THE PREFERRED EMBODIMENT

The steels of the present invention forming the steel plates are a unique discovery to be used as the cost effective replacement for high tensile strength (HTS) steels currently used in naval surface-ship construction. The steels of the present invention offer improved weldability, formability and fracture toughness resulting from unique micro-alloy chemical composition. By using plates of the composition of the present invention having an increased yield strength of 65 ksi, in lieu of the prior art HTS yield strength levels, plate thicknesses can be reduced to 1.25 inches or below to 0.375 inches, for example, for most structural design applications resulting in substantial weight reductions. Also significantly thinner plates require less welding and fabrication costs. Moreover, welds in thinner plate require substantially fewer passes as the volume of weld metal is reduced. It further follows that material costs will be reduced for specific structural designs since the purchase price from the steel mill will be about the same for the HTS plates but fewer tons of steel will be required embodying the present invention.

While reductions in welding, fabrication, and material costs will result whenever the steel plate of the present invention replaces the thicker HTS material, intangible benefits also accrue to the shipbuilder through the improved weldability, formability and material quality that will optimize ship structural design. The U.S. Navy, for which ships embodying the innovative steel plate are primarily to be constructed, will realize a number of benefits in the use of these ships. Such benefits include the reduction in weight and significant cost reductions while achieving positive improvements in performance and serviceability. It is estimated that the weight savings are $10,000 per ton over the ship's service life. When these benefits are taken together with improved quality, fracture toughness and survivability, ships constructed with steels of the present invention constitute a vast improvement over prior constructions with conventional steels.

For purposes of the present invention, the steels produced have a maximum practical thickness allowable for obtaining the mechanical properties desired of such plates. Grade 65 has a practical range of plate thicknesses of 0.375 to 1.25 inches.

The following table sets forth the minimum physical characteristics to be achieved by such steels:

TABLE 1

| | Tensile Requirements | | | |
|---|---|---|---|---|
| | Yield Strength | Tensile Strength | Minimum Elongation, %* | |
| Grade | min. ksi | min. ksi | In 8 in. | In 2 in. |
| 65 | 65 | 78 | 18 | 22 |

* For plates wider than 24 inches a) the yield strength is taken in the transverse direction and b) the above percentages are reduced two percentage points.

The minimum elongation percent as set forth above is in accordance with the standard test under ASTM designation: A370.

The steels of the present invention must also meet critical Charpy V-notch impact tests as set forth in the following table:

TABLE 2

| | Charpy V-Notch Impact Test Requirements | | |
|---|---|---|---|
| Grade | Temperature °F. | Longitudinal Specimens, min avg ft-lbf | Transverse Specimens, min avg ft-lbf |
| 65 | −40 | 30 | 20 |

The Charpy V-notch tests are to be performed in accordance with ASTM specification: E23-94a, a standard procedure for notched-bar impact testing of metallic materials.

To meet the foregoing physical characteristics the steels of the present invention must have the following composition in weight percentages:

a) carbon 0.03–0.10
b) manganese 1.10–1.65
c) phosphorous 0.25 max
d) sulfur 0.010 max
e) silicon 0.10–0.50
f) nickel 0.40 max
g) chromium 0.20 max
h) molybdenum 0.03–0.08
i) copper 0.35 max
j) vanadium 0.04–0.10
k) columbium 0.02–0.06
l) aluminum 0.03–0.08

Each of these constituents in the proportions set forth is important to achieve the physical characteristics set forth above for any produced steel plate. Each of these chemical elements produces in combination with the accompanying elements and in accordance with the heat treatments discussed hereinafter, particular and important advantages as follows.

Carbon is believed to be a key factor for improvement of the weldability measured by carbon equivalent formulas (Ceq and Pcm). In general, the lower the carbon content, the more improved the weldability. The carbon level also strengthens and hardens the steel.

Manganese adds to the strengthening and hardenability of the steel through solid solution strengthening of the microstructure. It also combines with sulfur to minimize welding and fabrication cracking problems.

Phosphorous is an impurity which has significant detrimental effects on the toughness of steel.

Sulfur is an impurity that has been demonstrated to adversely affect upper shelf and lower temperature impact strengths. It also affects the steel tendency for hot shortness and cracking in welds.

Silicon is an element that is found in all phases of steel refining and is useful for minimizing gaseous constituents.

Copper contributes to solid solution strengthening of the microstructure.

Nickel contributes to the hardenability and strengthening of the steel.

Chromium contributes to the hardenability and strengthening of the steel.

Molybdenum has a significant effect upon hardenability of the steel. In combination with vanadium, it is used for grain refinement during rolling and to maintain hardenability at elevated temperatures.

Vanadium strongly contributes to the solid solution hardenability of the microstructure and adds secondary hardening at the elevated temperatures while rolling. Along with molybdenum, vanadium greatly improves the grain refinement of the steel.

Columbium improves the lower temperature toughness through grain refinement during plate rolling.

Aluminum is a strong deoxidizer and is used to reduce the gas content in a technique known as killing the steel. Aluminum is also effective in controlling austenitic grain growth during rolling operations.

What is not able to be defined is the synergistic combination of these elements and the unique proportions specified that enable the steels of this composition, when heat treated as hereinafter stated, to achieve the desired physical characteristics outlined above.

The steel with the chemistry outlined above may be made in any one of the conventional furnaces such as the open-hearth, basic oxygen or electric furnace. Additional refining by electroslag remelting or vacuum-arc remelting is permitted and the steel is produced as an ingot or as a slab from a continuous caster and is then rolled and heat treated in accordance with one of the following procedures.

In the first and least expensive rolling process, the melted steel coming from the furnace with the composition of the present invention is either poured into an ingot or continuously cast into a slab. The product optionally may be soaked at 2100° F. minimum and preferably at 2250° F., for a time period at least 1 hour per inch thickness, to maintain columbium in solution in the austenitic steel. The slab is reduced by rolling in ambient air between the temperatures of 1900° F. to 1700° F. for a sufficient time so that as the columbium carbides and columbium carbo-nitride precipitates form, the austenitic grain size is refined. The steel is then further rolled in the temperature range from 1700° F. to 1450° F. in ambient air for a sufficient time to develop a fine grain ferrite with pearlite microstructure in the rolled steel plate.

EXAMPLE 1

A steel from the furnace was cast into a slab with the steel having composition of the following percentage: carbon 0.05, manganese 1.30, phosphorous 0.020, sulfur 0.010, silicon 0.25, nickel 0.30, chromium 0.18, molybdenum 0.05, copper 0.30, vanadium 0.06, columbium 0.035 and aluminum 0.05. The slab having a thickness of 10 inches was heat soaked for 10 hours at 2250° F. The slab was then rolled within a temperature range of 1900° F. to 1700° F. for a time sufficient to reduce the thickness to 2 inches and finally was rolled within the temperature range of 1600° F. to 1450° F. for a time sufficient to reduce the thickness to 1.25 inches so as to produce a steel meeting the required specifications.

In a second process, the slab of Example 1 having the same composition is subjected to a thermal-mechanical controlled rolling process. This slab may optionally be soaked at 2100° F. minimum and preferably at 2250° F. for a period of 1 hour for each inch thickness to maintain columbium in solution in the austenitic steel. The slab is rolled under the following conditions to control the austenitic grain size and prevent any recrystallization of the austenite during rolling. Rolling usually is started after soaking the slab between 2200° F. and 2350° F. Substantial rolling occurs as the slab cools from 1900° F. to 1615° F., the temperature at which transformation starts. Generally, rolling is stopped while the plate cools through the 1615° F. temperature and may be cooled by a water spray and thereafter rolling resumed in the range between 1615° F. and 1330° F. The finished plate is then allowed to slowly cool to ambient temperature or even may be directly quenched from a temperature above 1330° F.

EXAMPLE 2

A 12 inch thick steel slab with the composition of Example 1 was heat soaked at 2200° F. for 12 hours. Thereafter rolling continues as the slab cools from 1900° F. to 1615° F. The rolling is stopped and the plate cools through 1615° F. from a water spray and thereafter rolling is resumed between 1615° F. and 1330° F. to produce a 1.25 inch thick plate. The finished plate is then allowed to slowly cool to ambient temperature to produce a steel plate having the physical properties desired.

In the third process, a steel plate of the composition of Example 1 is subjected to a normalizing heat treatment consisting of heating the previously rolled steel plate to a temperature above 1450° F. and maintaining that temperature for an hour for each inch thickness to achieve a complete phase transformation from ferrite and pearlite (lamellar ferrite and cementite) to austenite to a temperature between 1450° F. and 1700° F. The steel plate is then removed from the heat treating furnace and permitted to cool in still air to ambient conditions.

EXAMPLE 3

A previously rolled 1.25 inch thick steel plate having a composition of Example 1 is heated between 1450° F. and 1700° F. for 1.25 hours and then is removed from the furnace to cool to ambient conditions. This plate subjected to the foregoing normalizing heat treatment possessed the physical characteristics desired.

In a fourth process for treating a steel of the composition of Example 1, the steel plate that has been previously rolled is subjected to a quenched and tempered heat treating process in which the steel plate is heated above the austenite phase transformation between 1450° F. and 1700° F. The plate is held at this temperature in the heat treating furnace for approximately 1 hour per inch thickness. After this holding period, the plate is removed from the furnace and then is immediately placed in the quenchant medium that may be oil, water, forced air or other quenchants. The plate is cooled in the quenchant to at least below 600° F. before it is removed from the quenchant. Following the quenching operation the steel plate receives a tempering cycle to relax a portion of the locked-in residual stresses from quenching. To accomplish this, the steel plate is placed in the furnace at a temperature between 1050° F. and 1330° F. and held at this temperature for approximately 1 hour per inch of thickness. When the plate is removed from the tempering furnace, it may be cooled in still air or in an accelerated coolant.

EXAMPLE 4

A previously rolled 1.25 inch thick steel plate having the composition of Example 1 is heated above the austenite phase transformation between 1450° F. and 1700° F. The plate is held within this temperature range for 1.25 hours. The plate is then removed from the furnace and placed in a quenchant medium of oil to cool the plate below 600° F. when it is removed from the quenchant. Thereafter the steel plate is subjected to a tempering cycle and the plate is placed in a furnace of temperature of about 1200° and held at approximately that temperature for 1.25 hours. Thereafter the plate is removed and is cooled in still air. It has been found that such a plate meets the physical characteristics and requirements of the present invention.

Any one of the steel plates from the above examples can be used in the construction of naval ships or other marine vessels in a thickness from 0.375 inches to up to 1.25 inches to achieve a measure of strength, weight reduction and economy not heretofore available to marine engineers.

The foregoing invention should be limited solely by the scope of the following claims in which we claim:

1. The process of producing a high strength, weldable steel having improved toughness comprising:

providing a steel of the following composition in weight percentages:

a) carbon 0.03–0.10
b) manganese 1.10–1.65
c) phosphorous 0.025 max
d) sulfur 0.010 max
e) silicon 0.10–0.50
f) nickel 0.40 max
g) chromium 0.20 max
h) molybdenum 0.03–0.08
i) copper 0.35 max
j) vanadium 0.04–0.10
k) columbium 0.02–0.06
l) aluminum 0.03–0.08 heating a rolled steel plate embodying said composition to a temperature between about 1450° F. and 1700° F. to complete a phase transformation from ferrite and pearlite to austenite, and cooling said steel plate to ambient temperature.

2. The process of claim 1 including, said heating being for a time of about 1 hour per inch thickness of said steel plate.

3. The product produced in accordance with the process of claim 1.

4. The process of producing a high strength, weldable steel having improved toughness comprising:

providing a steel of the following composition in weight percentages:

a) carbon 0.03–0.10
b) manganese 1.10–1.65
c) phosphorous 0.025 max
d) sulfur 0.010 max
e) silicon 0.10–0.50
f) nickel 0.40 max
g) chromium 0.20 max
h) molybdenum 0.03–0.08
i) copper 0.35 max j) vanadium 0.04–0.10
k) columbium 0.02–0.06
l) aluminum 0.03–0.08 heating a rolled steel plate embodying said composition to a temperature between about 1450° F. to 1700° F. to complete a phase transformation from ferrite and pearlite to austenite, quenching said steel plate to at least below a temperature of about 600° F., tempering to relieve quenching stresses at a temperature of between about 1050° F. to 1330° F., and cooling said steel plate.

5. The process of claim 4 wherein, said quenching is in a quenchant selected from the group consisting of oil, water and forced gas.

6. The process of claim 4 wherein, said steel plate is held at said temperature of 1450° F. to 1700° F. for a time of about 1 hour per inch thickness.

7. The process of claim 4 wherein, said steel plate is held at said temperature of 1050° F. to 1330° F. for a time of about 1 hour per inch thickness.

8. The process of claim 4 wherein, said quenching is in a quenchant selected from the group consisting of oil, water and forced gas, said steel plate is held at said temperature of 1450° F. to 1700° F. for a time of about 1 hour per inch thickness, and said steel plate is held at said temperature of 1050° F. to 1330° F. for a time of about 1 hour per inch thickness.

9. The product produced in accordance with the process of claim 4.

* * * * *